US005272845A

United States Patent [19]

Burkley

[11] Patent Number: 5,272,845

[45] Date of Patent: Dec. 28, 1993

[54] ROTARY SURFACE FINISHING DEVICE

[76] Inventor: Ralph A. Burkley, 444 Hampton Ridge Dr., Akron, Ohio 44313

[21] Appl. No.: 998,661

[22] Filed: Dec. 30, 1992

[51] Int. Cl.[5] ..... B24B 45/00

[52] U.S. Cl. ..... 51/364; 51/337; 51/358; 51/376; 51/370

[58] Field of Search ..... 51/355, 364–365, 51/369, 370, 371, 372, 366, 367, 368, 382, 383, 384, 388, 399, 400, 401, 330–337, 376, 377, 378

[56] References Cited

U.S. PATENT DOCUMENTS

| | | | |
|---|---|---|---|
| 1,897,971 | 2/1933 | Johnston | 51/337 |
| 2,175,073 | 10/1936 | Amstutz | 51/401 |
| 2,316,161 | 5/1939 | Harvey | 51/209 |
| 2,440,856 | 5/1948 | Harrison | 51/337 |
| 2,690,632 | 9/1953 | Sevick | 51/207 |
| 2,771,720 | 11/1956 | Field | 51/364 |
| 3,250,045 | 9/1963 | Caserta | 51/209 |
| 3,844,072 | 10/1974 | Haigh et al. | 51/401 |
| 4,837,985 | 6/1989 | Mayama | 51/364 |
| 4,951,423 | 8/1990 | Johnson | 51/168 |

*Primary Examiner*—Bruce M. Kisliuk
*Assistant Examiner*—Eileen Morgan
*Attorney, Agent, or Firm*—Paul E. Milliken; Lee A. Germain

[57] ABSTRACT

A rotary tool for performing surface finishing operations such as sanding, grinding, buffing, polishing and others. The tool has a rotary spindle with a shank portion at one end of which is retained by a rotary chuck of a power source. A portion of the spindle at the opposite end has a flexible planar surface finishing member attached to it in such manner that the member lies in a common plane with the longitudinal axis of the spindle. The finishing member is preferably made of multiple flexible layers fastened together by a centrally located eyelet. The finishing member bends when rotated against a flat or curved surface to be finished and sweeps in a linear direction across the surface. This tool is especially useful for deburring holes and is self centering when inserted in a hole.

20 Claims, 6 Drawing Sheets

ROTARY SURFACE FINISHING DEVICE

FIELD OF THE INVENTION

This invention relates to rotary surface finishing tools such as sanders, grinders, polishers and the like and more specifically to a planar surface finishing member which lies in a common plane with the longitudinal axis of rotation of a spindle to which it is fastened.

BACKGROUND OF THE INVENTION

Various prior art devices have been developed to perform surface finishing operations such as sanding, grinding, buffing, polishing and stropping. Examples of such devices are disclosed in U.S. Pat. Nos. 2,175,073, 2,316,161, 2,690,632, 3,250,045, 3,844,072, 4,837,985, and 4,951,423. With the exception of the '985 patent issued to Mayama which shows a cylindrical abrasive member, all the rest of the patents listed above show various disc shaped members which are attached to one end of a spindle and which lie in a plane which is substantially perpendicular to the spindle. The discs may have finishing textures or surfaces suitable for sanding, polishing or other finishing operations and the finishing textures or surfaces may be on one or both sides of such disc members. When there are finishing surfaces on both sides of the disc member, the member can be attached to the end of the spindle with either side facing away from the end of the spindle to perform the finishing operation. Then, when one side of the disc is worn the disc can be removed from the spindle and replaced with the unworn side facing away from the end of the spindle in a direction to perform the finishing operation. When discs are mounted on the end of a spindle in a plane perpendicular to the spindle, the disc rotates in a circumferential direction when the spindle is rotated and the finishing surface of the disc engages the surface to be finished in a circular motion. In some instances this can leave a circular or swirling pattern on the surface being finished. The present invention contacts the surface being finished in a linear sweeping motion quite similar to that of a belt sander and therefore does not leave any circular or swirling pattern on the finished surface.

The disc members in the above patents are designed for finishing a flat surface or gradually curving surfaces but are not capable of finishing the inside of holes or irregular surfaces with small radius curves. The present invention as hereinafter described, is capable of finishing the surfaces of both flat and curved surfaces as well as the inside of holes.

OBJECTS OF THE INVENTION

It is an object of this invention to provide a simple inexpensive rotary surface finishing tool which makes contact with the surface to be finished in a linear sweeping motion rather than a circular motion.

Another object of this invention is to provide a rotary surface finishing tool which is capable of finishing various contours of surfaces including the inside wall surfaces surrounding holes of various sizes.

Still another object of this invention is to provide a rotary surface finishing tool which will automatically center itself when finishing the inside wall surfaces of holes.

Another object of this invention is to provide a flexible rotary surface finishing tool which will bend to adjust to the diameter of a hole into which it is inserted while the tool is being rotated.

An even further object of this invention is to provide a rotary surface finishing tool having a surface finishing member which can be moved to different relative positions with respect to the longitudinal axis of a spindle on which it is mounted to assure maximum use is made of the entire surface finishing texture on both sides of the surface finishing member.

These and other objects of the invention will become more fully apparent in the following specification and the accompanying drawings.

SUMMARY OF THE INVENTION

This invention is a flexible rotary surface finishing device connectable to a source of rotary power, the device comprising: a rotatable elongated spindle having a first portion at one end adapted to be connected to a rotary power source for rotation about its longitudinal axis, and at least one flexible planar finishing member having surface finishing characteristics facing outwardly from each opposite side thereof attached to a second portion of the spindle adjacent the opposite end from the first portion, the finishing member lying in a common plane with the longitudinal axis of the spindle, and extending radially outwardly in opposite directions from the longitudinal axis of the spindle when not bearing against a surface to be finished, but changing to a cross-sectional contour of S-shaped configuration when the finishing member is rotated about the longitudinal axis of the spindle while bearing against a surface to be finished.

DESCRIPTION OF THE PREFERRED EMBODIMENTS

Figure 1:
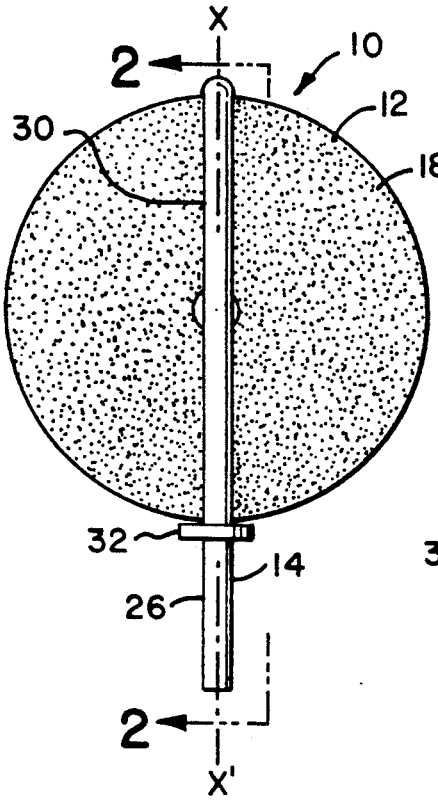
FIG. 1 is a plan view of the rotary surface finishing tool of the invention.
Figure 2:
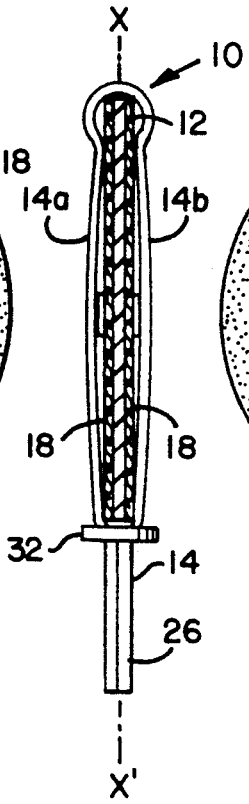
FIG. 2 is a cross-sectional view taken on line 2—2 of FIG. 1.
Figure 3:
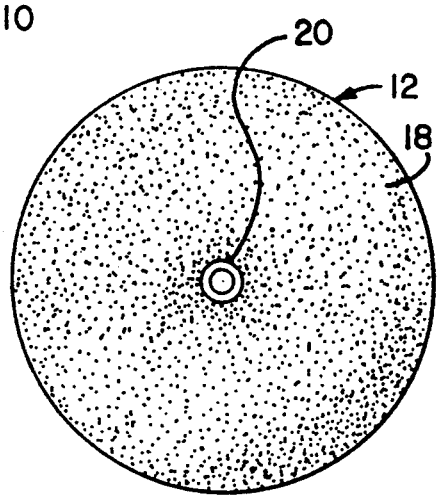
FIG. 3 is a plan view of a flexible surface finishing member of the tool shown in FIGS. 1 and 2.
Figure 5:
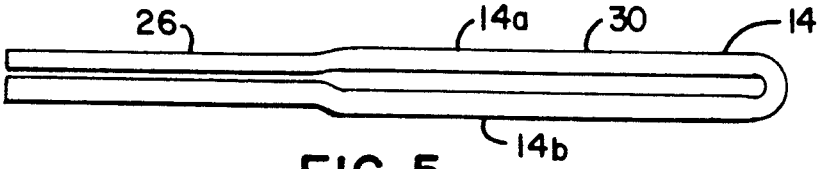
FIG. 5 is a side view of a spindle of the type used with the tool shown in FIGS. 1 and 2.

Referring now to the drawings and in particular to FIGS. 1 and 2, an assembled finishing tool is indicated generally by the numeral 10. The tool is comprised of a flexible planar surface finishing member 12 shown in FIGS. 1 through 3 which is removeably mounted in a split spindle 14 as show in FIGS. 1 and 2 and also shown individually in FIG. 5.

Figure 4:
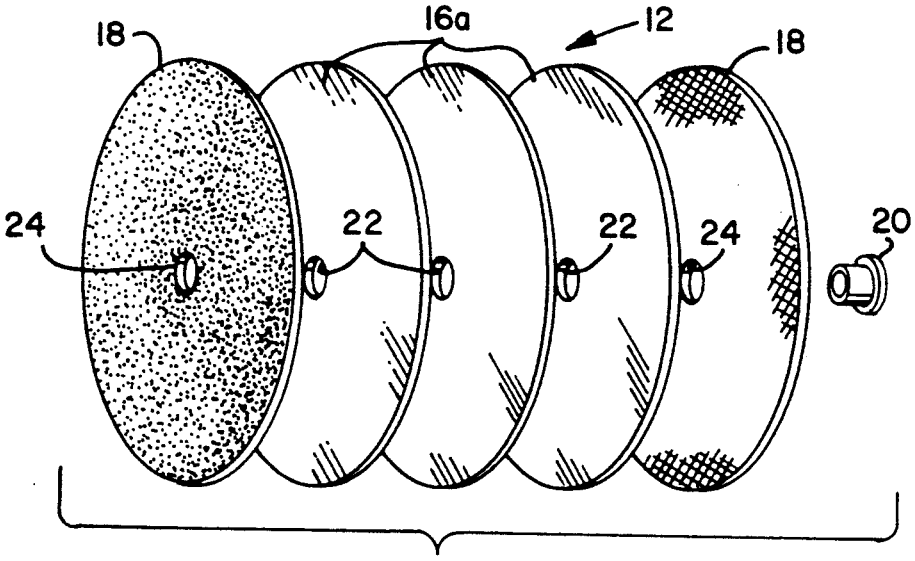
FIG. 4 is an exploded view of the finishing member shown in FIG. 3 showing the multiple layers which comprise the member.

The member 12 as shown in detail in FIG. 4 is a sandwich structure having a center core 16 of three flexible plastic discs 16*a* and an outwardly facing sanding disc 18 on each side of the core 16 all of which discs are held together by an eyelet or grommet 20 which passes through holes 22 and 24 respectively of the discs 16*a* and 18.

Figure 6:
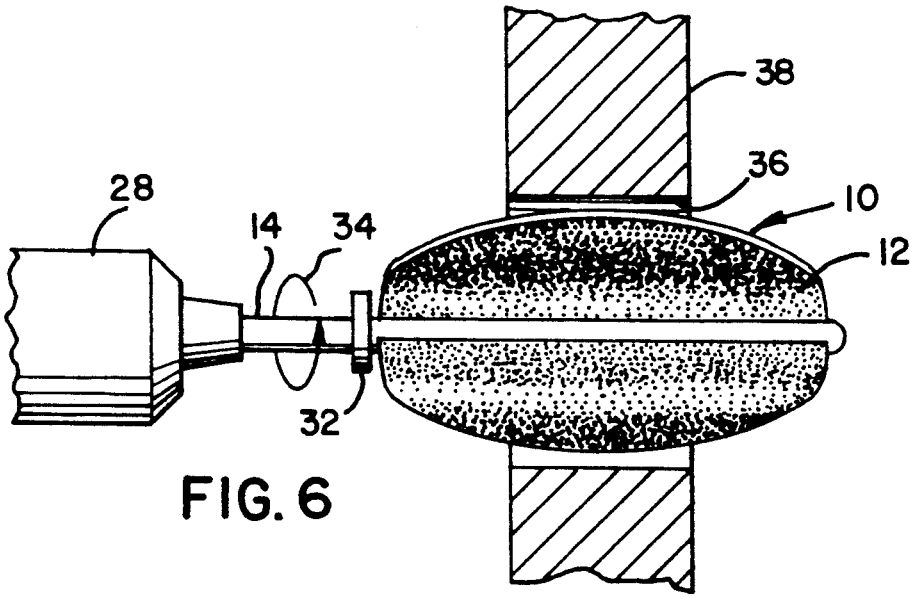
FIG. 6 is a cross-sectional view of the apparatus of the invention taken on line 6—6 of FIG. 7.

The split spindle 14 has, adjacent to one end, a shank portion 26 to be engaged by a rotatable chuck such as the chuck 28 shown in FIG. 6, and adjacent the opposite end, a disc receiving portion 30 through which the finishing member 12 is inserted as shown in FIGS. 1 and 2. A cinch ring 32 is slid over the shank portion 26 to a location close to one edge of the member 12 thereby clamping halves 14*a* and 14*b* of the spindle 14 firmly together to grip the member 16 along the longitudinal axis X—X' of the spindle 14 so that the member 16 is retained in a centered position with respect to the axis X—X' with each half of the member 16 extending radially outwardly to form a substantially identical projection which is symmetrical on each side of the axis X—X'.

The plastic discs 16*a* in this embodiment are made from MYLAR® plastic film or other material having the desired physical properties to provide the amount of needed flexibility to permit the rotating finishing member 12 to bend or flex when moved into contact with a surface to be finished and yet having a sufficient resistance to bending to cause the textured finishing surface of the member to apply a pressure to the surface being finished as the flexed rotating finishing member 12 sweeps in a linear path across the surface being finished. The amount of load or pressure exerted on the surface by the finishing member 12 depends upon the construction of the core 16, the number of layers in the core, the thickness of each layer, and the radial dimension of the finishing member 12. Increasing the thickness of the discs 16*a* and the number of discs in the core 16 increases the load applied by the member 12 to the surface being finished. If the member 12 is made from a single layer with a finishing texture on each side thereof, then the load applied by the member will depend upon the thickness of the member, the material from which the member is constructed, and the radial dimension of the member 12.

Figure 7:
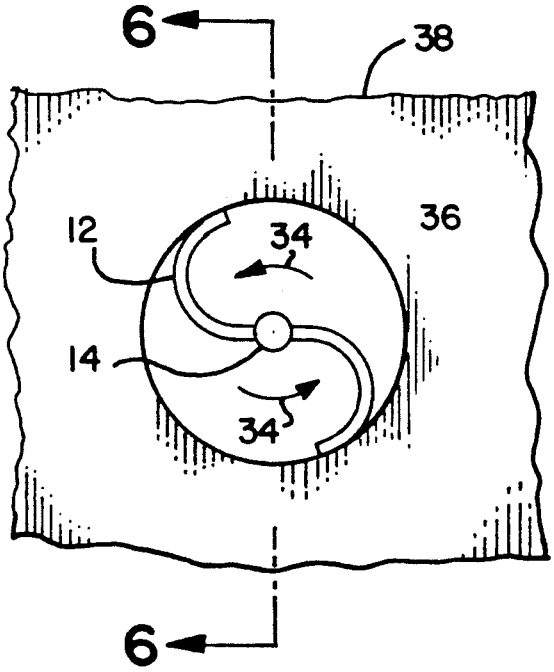
FIG. 7 is an end view of the apparatus of the invention showing the tool being rotated within a hole being finished.

Referring now to FIGS. 6 and 7, the tool 10 has its spindle 14 retained by the rotating chuck 28 which is rotating in the direction of the arrows 34 while being inserted in a hole 36 in a workpiece 38.

For simplicity the chuck 28 has been omitted from FIG. 7 to better show the finishing member 12 bending in an S-shape in cross-section as it sweeps the interior surface of the hole 36. It should be understood that the member 12 would, in most instances, be constructed of multiple layers such as that shown in FIG. 4.

Figure 8:
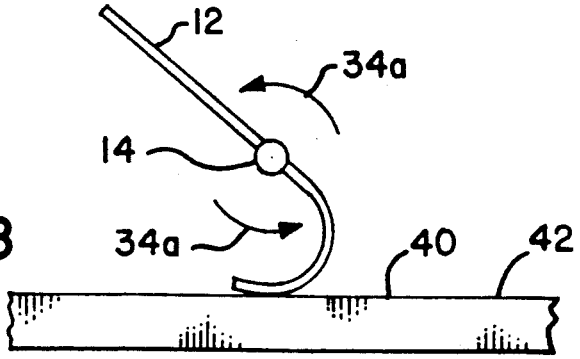
FIG. 8 is an end view of the apparatus of the invention similar to FIG. 7 but showing the tool being rotated against a flat surface being finished.
Figure 9:
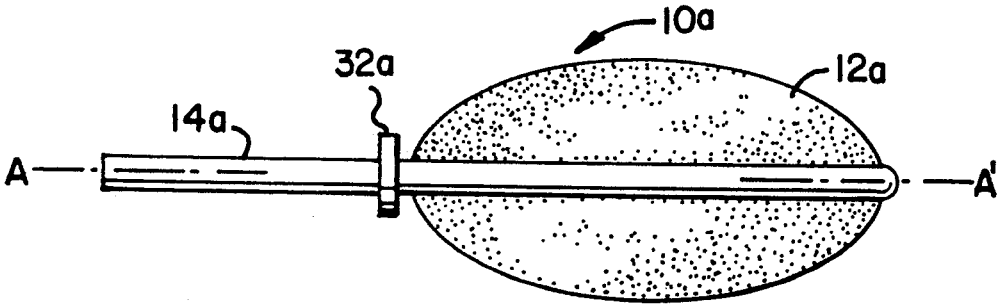
FIG. 9 is a plan view of another embodiment of the invention showing a finishing member of elliptical shape.
Figure 10:
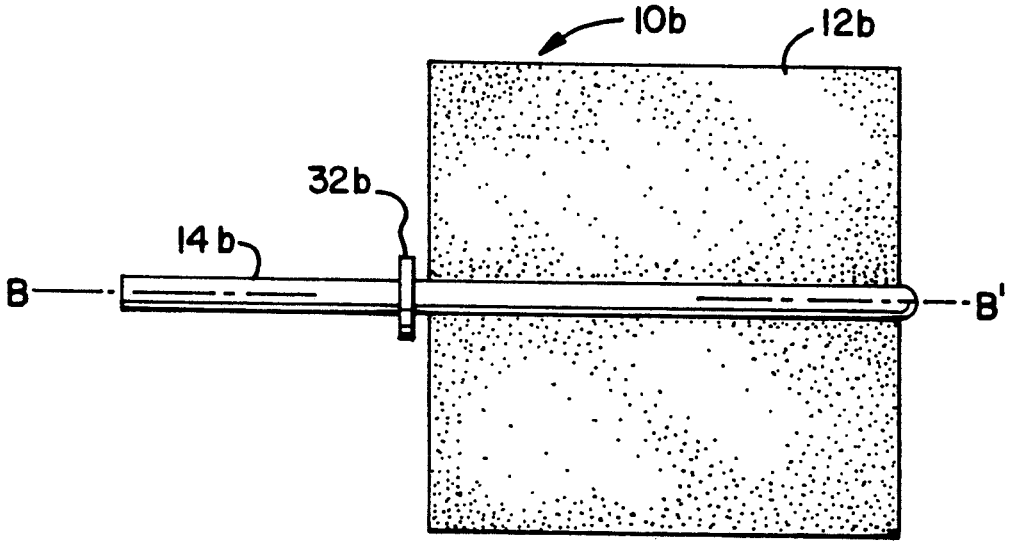
FIG. 10 is a plan view of another embodiment of the invention showing a finishing member of square shape.
Figure 11:
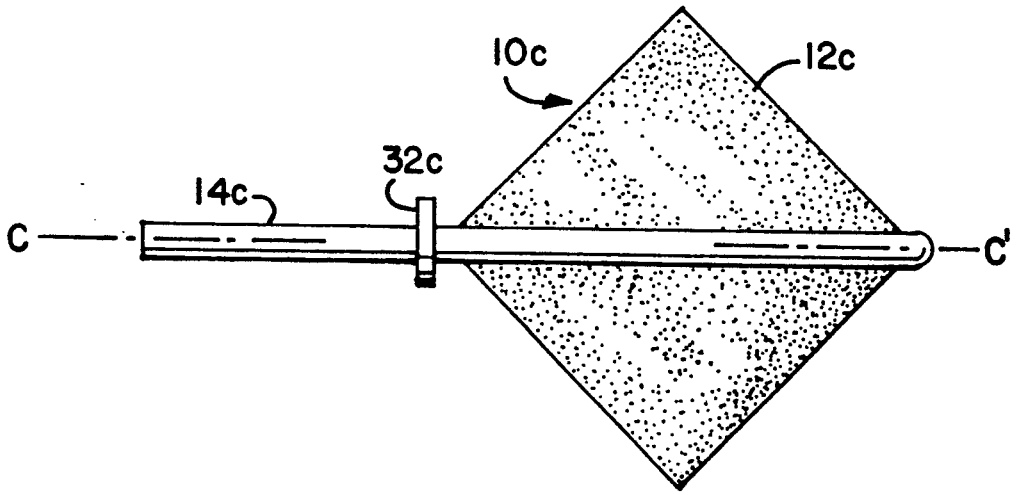
FIG. 11 is a plan view of another embodiment of the invention showing a finishing member of diamond shape.

In FIG. 8 the member 12 is shown being rotated against a flat surface 40 of a workpiece 42 while rotating in the direction of the arrows 34*a*. In this instance the member 12 bends into a J-shape when making contact with the surface 40.

Figure 12:
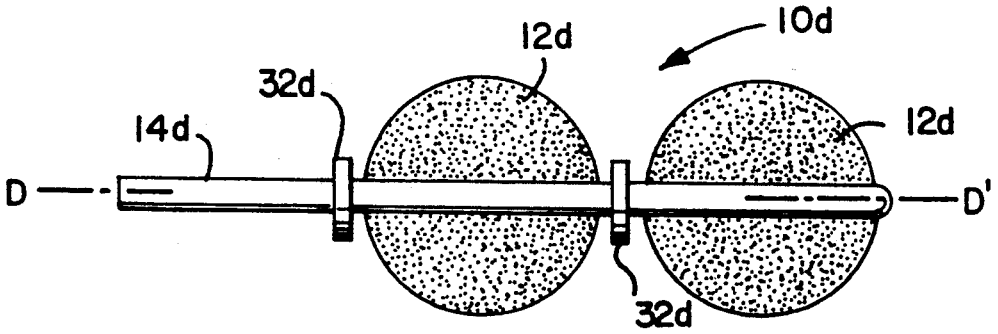
FIG. 12 is a plan view of another embodiment of the invention showing a multiple member of circular shape mounted in tandem along the axial length of a rotatable spindle.

FIGS. 9 through 12 show tools 10*a* through 10*d* respectively, having different shapes of surface finishing members indicated respectively by the numerals 12*a* through 12*d* retained in similar spindles 14*a* through 14*d*. As shown in FIGS. 9 through 12, the finishing member can vary in shape from circular, elliptical, square, diamond shaped, or other shapes and can also be mounted in tandem on the spindle as shown in FIG. 12 where two circular sanding members 12*d* are mounted in tandem on the spindle 14*d* and are clamped in position by the cinch rings 32*d*. The spindles 14*a* through 14*d* are rotatable about respective axes A—A' through D—D'.

Figure 13:
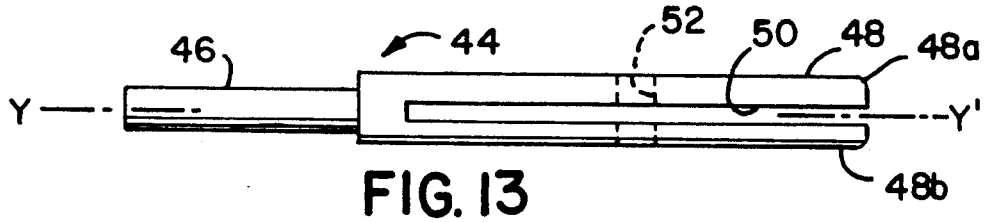
FIG. 13 is a side view of an alternative embodiment of a spindle from that shown in FIG. 5.
Figure 14:
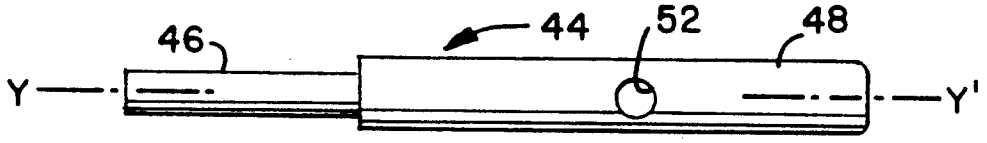
FIG. 14 is a plan view of the embodiment of spindle shown in FIG. 13.

A modified design of spindle 44 is shown in FIGS. 13 and 14. The spindle 44 has a solid shank portion 46 to be received by a rotary chuck such as the chuck 28 in FIG. 6. Extending from the shank portion 46 is a split portion 48 having a slot 50 extending therethrough in the same plane as the longitudinal axis Y—Y' and dividing the split portion 48 in two sides 48*a* and 48*b*. A transverse hole 52 extends through the split portion 48 and is preferably centered through the axis Y—Y'. When a surface finishing member such as the circular member 12 is positioned in the slot 50, a screw (not shown) is passed through the hole 52 and through the eyelet 20 of the member 12 to hold the member in a fixed position in the slot 50. The screw may be used with a nut to permit the sides 48*a* and 48*b* to be clamped together against the member 12 to hold it securely along axis Y—Y'. As an alternative, the hole 52 in one of the sides 48*a* or 48*b* can be threaded to engage the screw to permit the screw to be used without at nut. It can be seen that various types of spindles may be used to retain the material finishing member and in some instances the finishing member may be permanently secured to the spindle. There is of course advantages to having the finishing member removeably mounted on the spindle. The life of the finishing member 12 can be extended by changing the relative position of the member 12 in relationship to the longitudinal axis of the spindle. For example the sanding disc assembly 12 as shown in FIGS. 1 and 2 can be rotated circumferentially about its center at the eyelet 20 to different positions with respect to the axis X—X'. As certain parts of the sanding surface wear or the sanding grit becomes clogged with sanding residue, the disc assembly 12 can be rotated to a position where unworn grit can be used.

When the sanding discs are backed by square woven fabric or similar materials having a warp and woof to the fabric, it is important that the warp of one of the discs such as 18 in FIG. 4 is aligned with the warp of the other disc 18. Likewise the woof of the two discs should be aligned with each other. If the warps and woofs of the two discs are not properly aligned with each other, this creates an unbalanced condition in the finishing member 12 and results in undesirable vibration.

Figure 15:
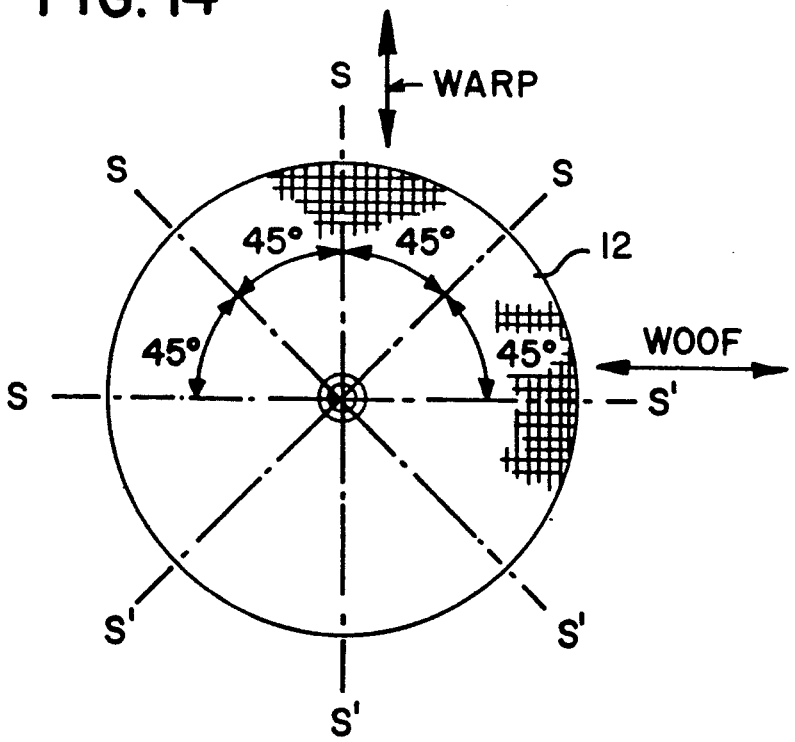
FIG. 15 is a diagrammatic view showing various alternatives for proper orientation of the warp and woof threads in fabric backed outer discs such as those used in the assembly shown in FIG. 4.

Another factor which should be taken into account when positioning the finishing member such as 12 on the spindle 14 is the relative angular orientation of the warp and woof cf the sanding discs relative to the longitudinal axis X—X' of the spindle 14. This is illustrated diagrammatically in FIG. 15 where a spindle axis is indicated by the lines S—S'. In FIG. 15 the warp of the disc 12 is shown running vertically and the woof runs horizontally. FIG. 15 shows the various relative locations where the axis S—S' can lie in relation to the warp and woof without creating a condition on unbalance and vibration provided that the warp and woof of both opposite sanding discs such as 18 are properly aligned with each other when the assembly of the member 16 is fastened together with the grommet. As shown in FIG. 15 the warp can be aligned with axis S—S', at 45° or at 90° to the axis. Likewise, the woof can be aligned with axis S—S', at 45° or at 90° to the axis.

Once the assembly of discs 16*a* and 18 shown in FIG. 4, are fastened to together by eyelet 20 and clamped in the spindle 14 along axis X—X' the discs will not move circumferentially with respect to each other, but can move radially a limited distance with respect to each other when the finishing member is bent as shown in FIGS. 7 or 8 when bearing against a surface being sanded or otherwise finished.

Figure 16:
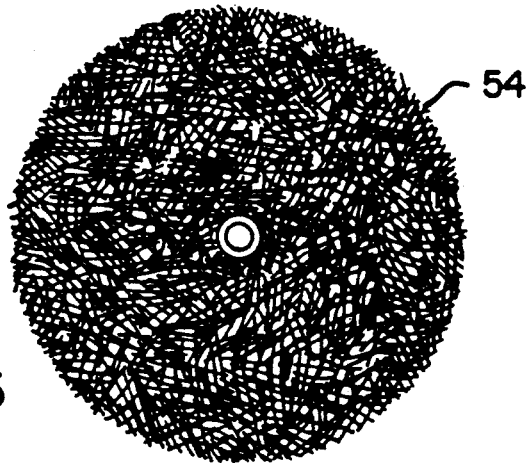
FIG. 16 is a plan view of a flexible surface finishing member similar to that shown in FIG. 3 but having a surface finishing disc made of random fibers.
Figure 17:
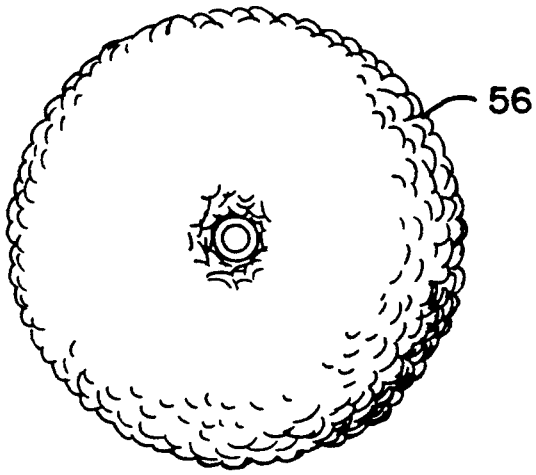
FIG. 17 is a plan view of a flexible surface finishing member similar to that shown in FIG. 3 but having a surface finishing disc made of wool.
Figure 18:
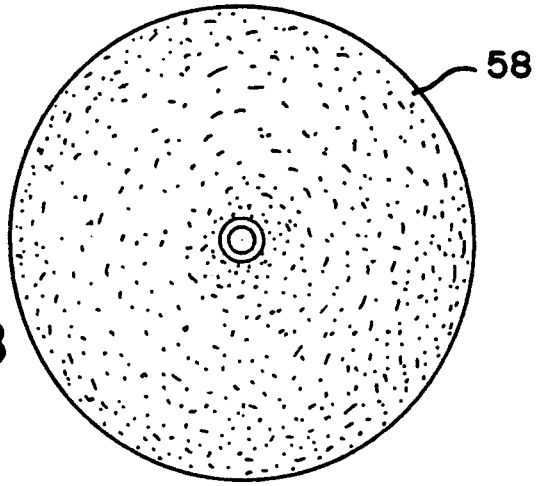
FIG. 18 is a plan view of a flexible surface finishing member similar to that shown in FIG. 3 but having a surface finishing disc made of felt.

While for the purpose of describing the assembly and operation cf the finishing tool of the invention, a sanding disc has been described, it will be recognized that it is also possible to replace the sanding discs with finishing materials having different textures such as scouring pads 54 of unwoven random fibers shown in FIG. 16, wool finishing disc 56 shown in FIG. 17, felt finishing disc 58 shown in FIG. 18, as well as steel wool, leather or other materials, not shown, having various surface finishing characteristics. Thus the tool can be adapted to perform sanding, grinding, polishing, buffing or stropping by simply changing the type of disc or finishing member that is mounted in the spindle.

Figure 19:
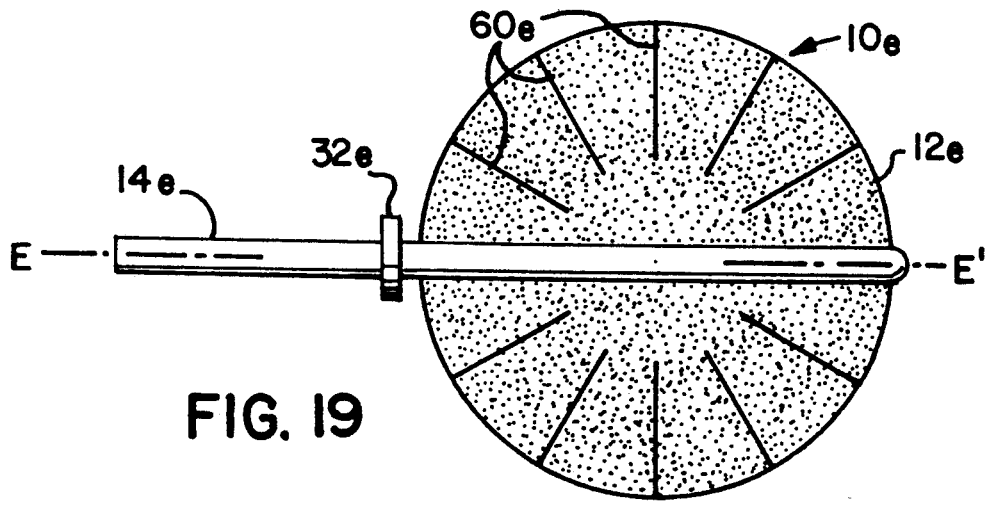
FIG. 19 is a plan view similar to FIG. 1 but with radial slits in the round finishing member of the surface finishing tool.

Another variation of the embodiment shown in FIG. 1 is shown in FIG. 19 which shows a tool 10*e* having a spindle 14*e*, with a cinch ring 32*e* retaining a round surface finishing member 12*e* similar to the member 12 in FIG. 1 but having a series of radial slits 60*e* extending through the member 12*e* to enable the member 12*e* to conform more easily to the contour of certain surfaces against which it may be rotated as explained previously with regard to the member 12 in FIGS. 6–8.

Figure 20:
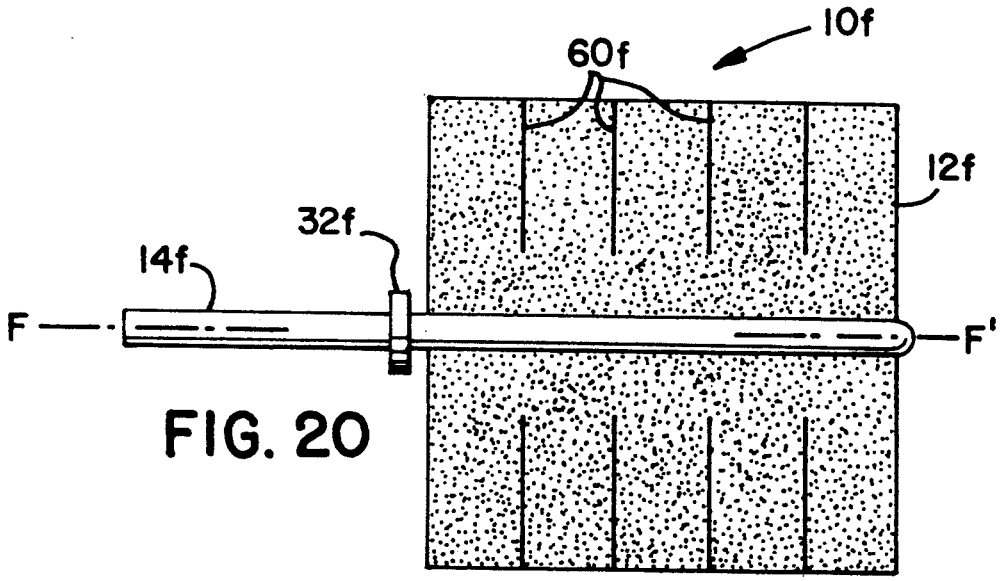
FIG. 20 is a plan view similar to FIG. 10 but with laterally extending slits in the square finishing member.

Likewise in FIG. 20, a surface finishing member 12*f* on a spindle 14*f* may have a series of laterally extending parallel slits 60 through the member 12*f* to enable the member 12*f* to conform more readily to the contour of a surface which it is finishing.

Figure 21:
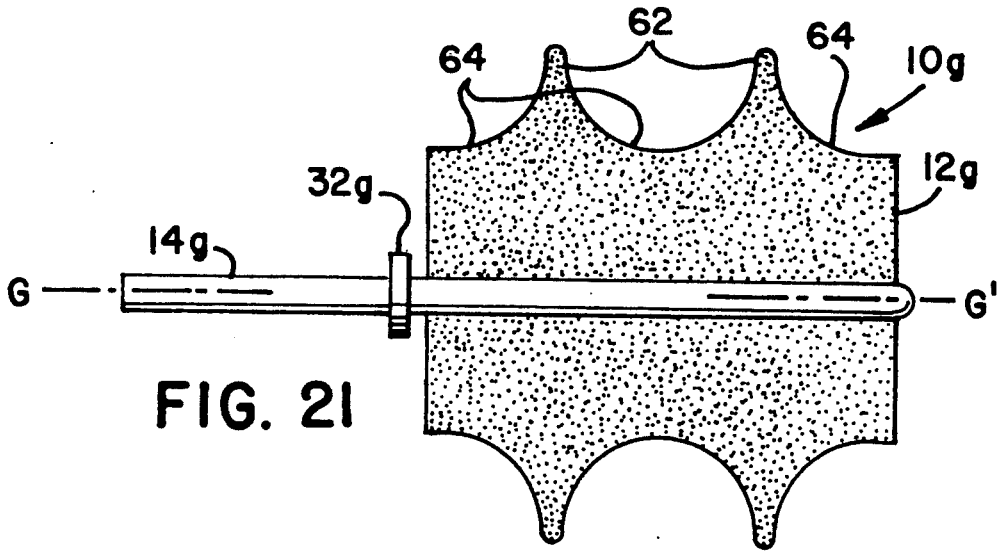
FIG. 21 is a plan view of another embodiment of a finishing member having a fluted or compound curved contour.

Finally FIG. 21 shows a finishing member 12*g* having a fluted countour comprised of laterally outwardly extending tips 62 and concave curved portions 64. Various such compound contours may be produced to fit certain contoured turnings on a lathe for finishing the coumpound curvatures of the part.

In FIGS. 19 through 21 the axes of rotation of the spindles 14*e*, 14*f* and 14*g* are indicated by the letters E—E', F—F' and G—G' respectively.

Any of the surface finishing members shown in any of the FIGURES of the drawings, regardless of their shape, can be made from multiple layers such as those shown in FIG. 4 or can be made of a single layer which has the desired degree of flexibility.

Various other embodiments of spindles and finishing members may also be used without departing from the scope of the invention.

I claim:

1. A flexible rotary surface finishing device connectable to a source of rotary power, said device comprising:

(A) a rotatable elongated spindle having a first portion at one end adapted to be connected to a rotary power source for rotation about its longitudinal axis and a second portion on the other end having a transverse slot extending therethrough dividing at least the second portion into spindle halves;

(B) at least one flexible planar finishing member having surface finishing characteristics facing outwardly from each opposite side thereof; and (C) an axially slidable retaining ring member encircling the spindle to urge the spindle halves inwardly to bear against opposite sides of the finishing member to removeably clamp the planar finishing member within the transverse slot between the spindle halves to prevent any movement of the finishing member transversely of the spindle;

(D) said finishing member lying in a single common plane with the longitudinal axis of the spindle, and extending radially outwardly in opposite directions from the longitudinal axis of the spindle.

2. A surface finishing device as claimed in claim 1 wherein the width of the finishing member in the radially extending direction varies from one location to another along the longitudinal axis of the spindle.

3. A surface finishing device as claimed in claim 2 wherein the width of the finishing member in the radial direction is greatest at the midpoint of the finishing member along the longitudinal axis of the spindle and is least at locations of the finishing member which lie along the longitudinal axis at the most remote distance from the midpoint thereof.

4. A surface finishing device as claimed in claim 1 wherein the finishing member is in the shape of a circular disc.

5. A surface finishing device as claimed in claim 4 wherein the finishing member can be periodically rotated circumferentially to various positions in relation to the longitudinal axis of the spindle to uniformly distribute the wear of the finishing member to various locations on the member.

6. A surface finishing device as claimed in claim 1 wherein a plurality of finishing members are attached to a common spindle.

7. A surface finishing device as claimed in claim 1 wherein the finishing member has at least one flexible intermediate member located between a pair of outer members each of which contains surface finishing characteristics on an outwardly facing surface.

8. A surface finishing device as claimed in claim 7 wherein the intermediate member and the outer members are mounted in fixed relationship with each other along the longitudinal axis of the spindle when fastened within the slot of the spindle but are movable with respect to each other at other locations at which they lie adjacent to each other.

9. A flexible rotary surface finishing device connectable to a source of rotary power, said device comprising:

(A) a rotatable elongated spindle having a forward end and a rearward end, a first portion adjacent the rearward end adapted to be connected to a rotary power source for rotation about its longitudinal axis and a second portion integral therewith adapted to receive a planar finishing member, both the first and second portions having a continuous transverse slot extending throughout their axial length and dividing both portions of the spindle into halves both of said halves being joined together at the forward end of the spindle;

(B) at least one flexible planar finishing member having surface finishing characteristics facing outwardly from each opposite side thereof positioned within the slot; and (C) means removeably clamping the planar finishing member between the spindle halves to retain the finishing member within the slot;

(D) said finishing member lying in a common plane with the longitudinal axis of the spindle, and extending radially outwardly in opposite directions from the longitudinal axis of the spindle.

10. A surface finishing device as claimed in claim 9 wherein the width of the finishing member in the radially extending direction varies from one location to another along the longitudinal axis of the spindle.

11. A surface finishing device as claimed in claim 10 wherein the width of the finishing member in the radial direction is greatest at the midpoint of the finishing member along the longitudinal axis of the spindle and is least at locations of the finishing member which lie along the longitudinal axis at the most remote distance from the midpoint thereof.

12. A surface finishing device as claimed in claim 9 wherein the finishing member is in the shape of a circular disc.

13. A surface finishing device as claimed in claim 12 wherein the finishing member can be periodically rotated circumferentially to various positions in relation to the longitudinal axis of the spindle to uniformly distribute the wear of the finishing member to various locations on the member.

14. A surface finishing device as claimed in claim 9 wherein the means removeably attaching the planar finishing member to the spindle is a retaining means engaging portions of the periphery of the spindle adjacent the slot to urge the halves of the spindle together in clamping relationship against the finishing member to hold it securely in the slot.

15. A surface finishing device as claimed in claim 14 wherein the retaining means is a ring member which is axially slideable along the spindle to a location adjacent to the finishing member when it is mounted in the slot in the spindle.

16. A surface finishing device as claimed in claim 9 wherein at least one of the spindle halves has a transverse hole therethrough and the means removeably clamping the planar finishing member between the spindle halves is a screw passing through the hole and engaging the finishing member at the center thereof.

17. A surface finishing device as claimed in claim 9 wherein the finishing member has at least one flexible intermediate member located between a pair of outer members each of which contains surface finishing characteristics on an outwardly facing surface.

18. A surface finishing device as claimed in claim 17 wherein the intermediate member and the outer members are mounted in fixed relationship with each other along the longitudinal axis of the spindle when fastened within the slot of the spindle but are moveable with respect to each other at other locations at which they lie adjacent to each other.

19. A flexible rotary surface finishing device connectable to a source of rotary power, said device comprising:

(A) a rotatable elongated spindle having a first portion atone end adapted to be connected to a rotary power source for rotation about its longitudinal axis and a second portion on the other end having a transverse slot extending therethrough dividing at least the second portion into spindle halves;

(B) at least one flexible planar finishing member in the shape of a circular disc having surface finishing characteristics facing outwardly from each opposite side thereof attached to a second portion of the spindle adjacent the opposite end from the first portion;

(C) an axially slidable retaining member encircling the spindle to urge the spindle halves inwardly to bear against opposite sides of the finishing member to removeably clamp the planar finishing member within the transverse slot between the spindle halves to prevent any movement of the finishing member transversely of the spindle;

(D) said finishing member lying in a single common plane with the longitudinal axis of the spindle, and extending radially outwardly in opposite directions from the longitudinal axis of the spindle, and said finishing member being periodically rotatable circumferentially to various positions in relation to the longitudinal axis of the spindle to uniformly distribute the wear of the finishing member to various locations on the member.

20. A surface finishing device as claimed in claim 19 wherein the finishing member has a plurality of slits extending radially to its outer edge.

* * * * *